United States Patent [19]

Khulbe et al.

[11] 4,252,634

[45] Feb. 24, 1981

[54] THERMAL HYDROCRACKING OF HEAVY HYDROCARBON OILS WITH HEAVY OIL RECYCLE

[75] Inventors: Chandra P. Khulbe; Barry B. Pruden, both of Ottawa; Jean-Marie D. Denis, Munster, all of Canada

[73] Assignee: Energy, Mines and Resources-Canada, Ottawa, Canada

[21] Appl. No.: 122,741

[22] Filed: Feb. 19, 1980

Related U.S. Application Data

[63] Continuation of Ser. No. 954,323, Oct. 24, 1978, abandoned.

[30] Foreign Application Priority Data

Nov. 22, 1977 [CA] Canada ..... 291501

[51] Int. Cl.[3] ..... C10G 9/16; C10G 47/00; C10G 47/22

[52] U.S. Cl. ..... 208/48 R; 208/107

[58] Field of Search ..... 208/48 R, 48 Q, 107, 208/108

[56] References Cited

U.S. PATENT DOCUMENTS

| | | | |
|---|---|---|---|
| 3,224,959 | 12/1965 | Schlinger et al. | 208/107 |
| 3,619,407 | 11/1971 | Hendricks et al. | 208/48 R |
| 3,725,247 | 4/1973 | Johnson et al. | 208/111 |
| 3,788,973 | 1/1974 | Wolk et al. | 208/48 R |
| 3,841,981 | 10/1974 | Laying | 208/48 Q |
| 3,842,122 | 10/1974 | Wolk et al. | 208/48 Q |
| 3,844,937 | 10/1974 | Wolk | 208/108 |
| 3,926,783 | 12/1975 | Wolk | 208/157 |
| 3,932,269 | 1/1976 | Lehman | 208/157 |

*Primary Examiner*—Delbert E. Gantz
*Assistant Examiner*—G. E. Schmitkons

[57] ABSTRACT

An improved process is described for the hydrocracking of heavy hydrocarbon oils, such as oils extracted from tar sands. The heavy hydrocarbon oil feedstock in the presence of an excess of hydrogen is passed through a confined hydrocracking zone under upflow liquid conditions, and the effluent emerging from the top of the hydrocracking zone is passed into a hot separator where it is separated into a gaseous stream containing hydrogen and vaporous hydrocarbons and a liquid stream containing heavy hydrocarbons. The hot separator is maintained near the temperature of the hydrocracking zone and the effluent from the hydrocracking zone enters the separator in a lower region below the liquid level in the separator. The gaseous stream containing hydrogen and vaporous hydrocarbons is withdrawn from the top of the separator while a portion of the liquid phase in the separator is recycled to the hydrocracking zone without further treatment and in quantities sufficient to increase the superficial liquid flow velocity in the hydrocracking zone such that deposition of coke in the hydrocracking zone is substantially eliminated.

4 Claims, 1 Drawing Figure

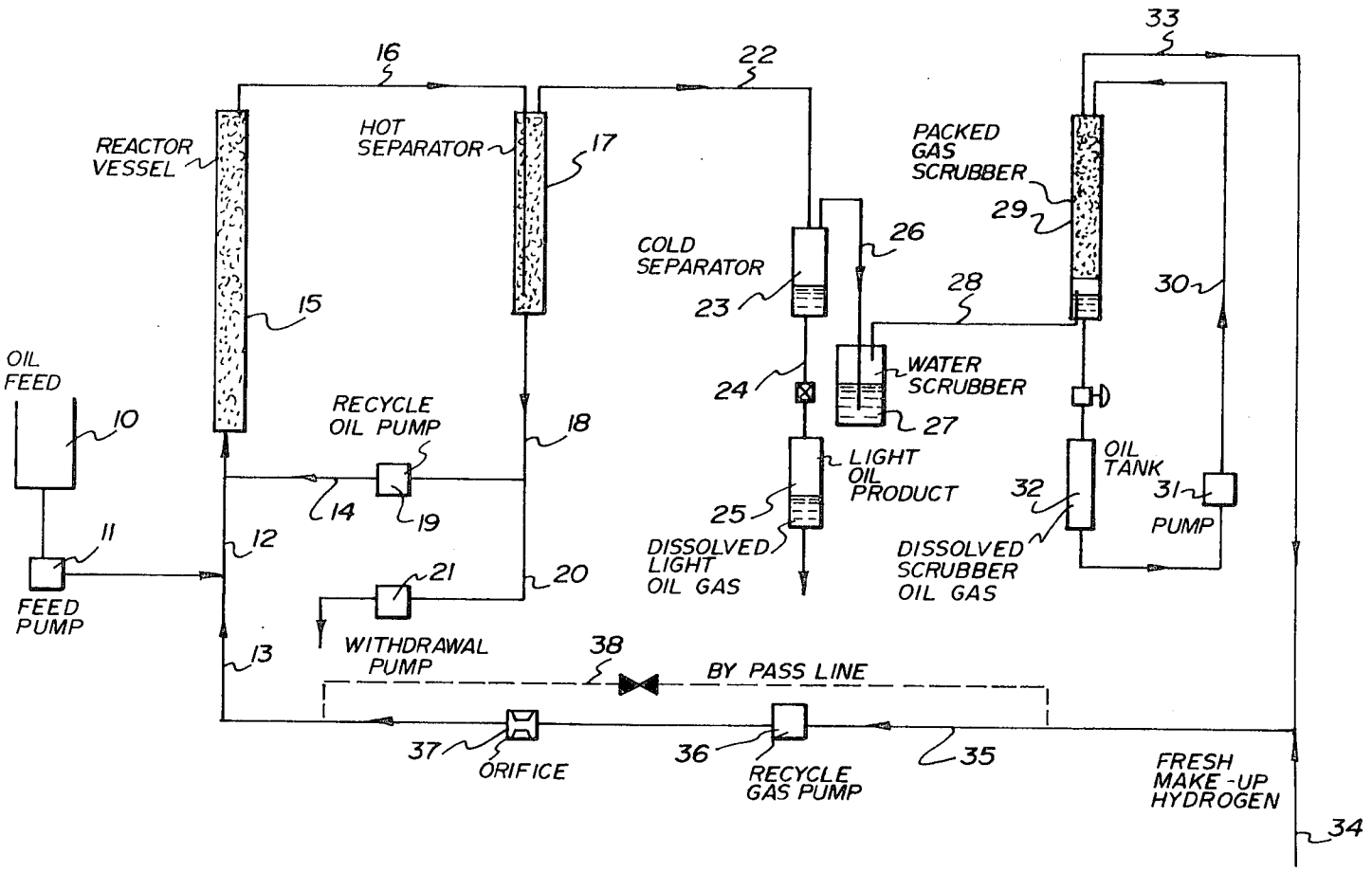
OIL FEED
FEED PUMP
REACTOR VESSEL
HOT SEPARATOR
RECYCLE OIL PUMP
WITHDRAWAL PUMP
COLD SEPARATOR
DISSOLVED LIGHT OIL GAS
LIGHT OIL PRODUCT
WATER SCRUBBER
PACKED GAS SCRUBBER
DISSOLVED SCRUBBER OIL GAS
OIL TANK
PUMP
FRESH MAKE-UP HYDROGEN
BY PASS LINE
RECYCLE GAS PUMP
ORIFICE
10
11
12
13
14
15
16
17
18
19
20
21
22
23
24
25
26
27
28
29
30
31
32
33
34
35
36
37
38

THERMAL HYDROCRACKING OF HEAVY HYDROCARBON OILS WITH HEAVY OIL RECYCLE

This is a continuation, of application Ser. No. 954,323, filed on Oct. 24, 1978, and now abandoned.

This invention relates to the treatment of hydrocarbon oils and, more particularly, to the hydrocracking of heavy hydrocarbon oils to produce improved products of lower boiling range.

Hydrocracking processes for the conversion of heavy hydrocarbon oils to light an intermediate naphthas of good quality for reforming feed stocks, fuel oil and gas oil are well known. These heavy hydrocarbon oils can be such materials as petroleum crude oil, atmospheric tar bottoms products, vacuum tar bottom products, heavy cycle oils, shale oils, coal-derived liquids, crude oil residuum, topped crude oils and heavy bituminous oils extracted from tar sands. Of particular interest are the oils extracted from tar sands and which contain wide boiling range materials from naphthas through kerosene, gas oil, pitch, etc. and which contain a large portion of material boiling above 524° C. These heavy hydrocarbon oils contain nitrogen and sulfur compounds in extremely large quantities and often contain excessive quantities of organo-metallic contaminants which tend to be detrimental to various catalytic processes which may subsequently be carried out, such as hydrofining. Of the metallic contaminants those containing nickel and vanadium are most common, although other metals are often present. These metallic contaminants, as well as others, are usually present within the bituminous material as organo-metallic compounds of relatively high molecular weight. A considerable quantity of the organo-metallic complexes are linked with asphaltenic material and contains sulphur.

As the reserves of conventional crude oils decline, the heavy oils must be upgraded to meet the demands. In this upgrading, the heavier material is converted to lighter fractions and most of the sulphur, nitrogen and metals must be removed. This is usually done by means of coking or hydrocracking processes. The coking processes involve removal of carbon resulting in 20% by weight or more material as coke. This material referred to as "coke" is a carbonaceous material which may contain insoluble organic material, mineral matter, metals, sulphur, quinoline and benzene soluble organic materials. The content of these other materials means that the coke cannot be used as a fuel and this represents an excessive waste of resources.

In the catalytic hydrocracking, the mineral matter present in the feed stock tends to deposit on the surface of the expensive catalyst, making it extremely difficult to regenerate, again resulting in increased production cost. The non-catalytic or thermal hydrocracking process can give a distillate yield of over 85 weight percent but in this process, there is a very considerable problem of the formation of coke deposits on the wall of the reactor which ultimately plug the reactor and cause costly shutdowns.

Various attempts have been made to prevent the formation of coke deposits in thermal hydrocracking processes and one such method is described in Wolk, U.S. Pat. No. 3,844,937, issued Oct. 29, 1974. That process utilized a high ash content in the hydrocracking zone fluid e.g. in the range of 4–10 weight percent as a means for preventing the formation of coke in the hydrocracking zone. In order to achieve this ash content in the fluid, a recycle of heavy hydrocarbons from a hot separator was used and as a part of this recycle, the heavy hydrocarbons from the hot separator were passed through a cyclone or through another low pressure separator. This was carried out at quite low recycle rates and, consequently, quite low liquid up-flow velocities in the hydrocracking zone.

Another prior system utilizing recycle of separator bottoms is Schlinger et al U.S. Pat. No. 3,224,959, issued Dec. 21, 1965. In that procedure, the heavy hydrocarbons from the hot separator are contacted with a separate hydrogen stream heated to a temperature between 800° and 950° F. and this hydrogen treated product is then recycled into the hydrocracking zone. This procedure involves extremely high hydrogen recirculation rates of up to 95,000 s.c.f./b.b.l. making the procedure very expensive. Moreover, the reaction zone is operated at a high turbulence which results in reduced pitch conversion with high operating and production costs.

It is the object of the present invention to provide a thermal hydrocracking procedure which can avoid the formation of coke deposits in the hydrocracking zone while using a simpler and less expensive system than those described in the prior art.

SUMMARY OF THE INVENTION

In accordance with the present invention, there is described a process for hydrocracking a heavy hydrocarbon oil feed stock, a substantial proportion of which boils above 524° C. which comprises:

(a) passing an intimate mixture of said heavy hydrocarbon oil and hydrogen through a confined hydrocracking zone under upflow liquid conditions, said hydrocracking zone being maintained at a temperature between about 460° and 490° C. and a pressure between about 500 and 3,500 psig., (b) removing from the top of said hydrocracking zone a mixed effluent containing a gaseous phase comprising hydrogen and vaporous hydrocarbons and a liquid phase comprising heavy hydrocarbons.

(c) passing said mixed effluent into a hot separator maintained near the temperature of the hydrocracking zone, the mixed effluent entering the separator in a lower region thereof below the liquid level in the separator, (d) withdrawing from the top of the separator a gaseous stream comprising hydrogen and vaporous hydrocarbons and (e) recycling a portion of the liquid phase from the separator maintained at a temperature between about 350° and 490° C. to the hydrocracking zone without further treatment and in quantities sufficient to increase the superficial liquid flow velocity in the hydrocracking zone such that deposition of coke in the hydrocracking zone is substantially eliminated.

This process substantially prevents the formation of carbonaceous deposits in the reaction zone. This was a quite surprising finding in view of the prior arts which required a much more complex system in order to prevent the coke formation. The present invention is based upon the realization that liquid linear velocities are a very important feature in the prevention of coke deposits. Thus, by introducing the effluent from the hydrocracking zone below the liquid level in the hot separator, a good mixing action was effected in the bottom of the hot separator including mixing of the hydrogen in the effluent stream with the heavy hydrocarbon liquid and stripping most of the light hydrocarbons from the heavy hydrocarbon liquid. This was effective in preventing coke deposition within the hot separator and made possible a very high rate of recycle of heavy hydrocarbons from the hot separator back to the hydrocracking zone. The resultant high liquid velocity appears to have a scouring action which is helpful in preventing agglomeration of particles and plugging of the hydrocracking zone.

The process of this invention is particularly well suited for the treatment of heavy oils having a large proportion, preferably at least 50% by volume, which boils above 524° C. It can be operated at quite moderate pressure in the range of 500–3,500 psig, preferably 500–2,500 psig., most preferably 1000–2000 psig, without coke formation in the hydrocracking zone. The temperature can be in the range of 400° to 490° C., with 430° to 470° C. being particularly preferred.

Although the hydrocracking can be carried out in a variety of known reactors, it is particularly well suited to a tubular reactor through which it moves upwardly. The effluent from the top of the reactor then passes into a hot separator maintained near the temperature of the hydrocracking zone, this effluent entering the hot separator in a lower region below the liquid level in the separator.

For best results the heavy hydrocarbons from the hot separator is recycled back into the fresh feed to the hydrocracking zone in a volume ratio of recycle to fresh feed of at least 2:1. It is also preferred that the combined recycle and fresh feed flow be at a rate such that the superficial liquid upflow velocity in the hydrocracking zone is at least 0.25 cm./sec. The liquid hourly space velocity is preferably in the range of 0.5 to 4.0.

It has also been found that the system does not require a high hydrogen recirculation to avoid coking. Thus, a hydrogen recirculation of about 2,000 to 10,000 scf per bbl of feed stock can be used.

The gaseous stream from the hot separator is preferably passed to a cold separator maintained at about 25° C. The non-condensable gases from the cold separator are passed through a water scrubber to remove ammonia and metal sulphides and then through an oil scrubber to remove $H_2S$ and light hydrocarbons. The effluent gas from the oil scrubber, rich in hydrogen, together with makeup hydrogen is recycled to the hydrocracking zone where it is combined with the feedstock, including recycled heavy hydrocarbons from the hot separator. The liquid stream from the cold separator represents the light hydrocarbon oil product of the present invention and can be sent for secondary treatment.

For a better understanding of the invention, reference is made to the accompanying drawing which illustrates diagrammatically a preferred embodiment of the present invention.

Heavy hydrocarbon oil feed 10 is pumped via feed pump 11 through inlet line 12 into the bottom of an empty tower 15. Recycled gases and makeup hydrogen from line 13 is simultaneously fed into tower 15 through line 12 along with recycle heavy hydrocarbons through line 14. A liquid-gas mixture is withdrawn from the top of tower 15 through line 16 and introduced into the bottom of hot separator 17. In the hot separator, the effluent from tower 15 is separated into a gaseous stream 22 and a liquid stream 18. The liquid stream 18 is in the form of a heavy hydrocarbon oil or pitch and a portion of this stream 18 is recycled through pump 19 and line 14 into inlet line 12. The balance of liquid stream 18 is received via line 20 and withdrawn via pump 21 for collection. The pump 21 may be eliminated in a commercial operation.

The gaseous stream from hot separator 17 is carried away by line 22 into a cold separator 23. Within this separator the product is separated into a gaseous stream rich in hydrogen which is drawn off through line 26 and an oil product which is drawn off through line 24 and collected in collector 25. This represents the light oil product of the invention.

The hydrogen rich stream 26 is passed through a water scrubber 27 to remove ammonia and metal sulphides and the stream 28 from the water scrubber is passed through a packed scrubbing tower 29 where it is scrubbed by means of organic scrubbing liquid 32 which is cycled through the tower by means of pump 31 and recycle loop 30. The scrubbed hydrogen rich stream emerges from the scrubber via line 33 and is combined with fresh make up hydrogen added through line 34 and recycled by line 35, through gas pump 36, orifice 37 and line 13 back to tower 15.

Certain preferred embodiments of the invention will now be further illustrated by the following non-limitative examples.

EXAMPLE 1

The charge stock employed was an Athabasca bitumen having the following properties:

| | |
|---|---|
| Specific gravity, 60/60° F. | 1.010 |
| Sulphur, wt. % | 4.73 |
| Ash, wt. % | 0.56 |
| Viscosity, cst at 210° F. | 175.8 |
| Conradson Carbon Residue, wt. % | 13.7 |
| Pentane Insolubles, wt. % | 15.6 |
| Benzene Insolubles, wt. % | 0.57 |
| Nickel, ppm | 68 |
| Vanadium, ppm | 211 |

DISTILLATION ANALYSIS

TABLE 1

| Temperature °C. | Temperature °F. | wt. % | Cumulative wt. % | Sp. Gr. | Sulphur wt. % |
|---|---|---|---|---|---|
| IBP–200 | IBP–392 | 1.4 | 1.4 | 0.816 | 1.52 |
| 200–250 | 392–482 | 2.2 | 3.6 | 0.856 | 1.02 |
| 250–333 | 482–632 | 9.7 | 13.3 | 0.904 | 1.78 |
| 333–418 | 632–785 | 17.7 | 31.0 | 0.955 | 2.98 |
| 418–524 | 785–975 | 17.5 | 48.5 | 0.989 | 3.80 |
| +524 | +975 | 51.5 | 100.0 | 1.073 | 6.39 |

The above feed stock was passed through the reaction sequence shown in the attached drawing using two different operating conditions as follows:

TABLE 2

| Run Number | R-2-1-2 | R-2-2-4 |
|---|---|---|
| Duration, h | 477 | 283 |
| Pressure MPa | 13.89 | 13.89 |
| Gas Flow, g mol/kg of feed | 51.56 | 51.56 |
| $H_2$ Purity, vol. % | 85 | 85 |
| LHSV, $H^{-1}$ | 1.0 | 1.0 |
| Reactor Temp. °C. | 450 | 460 |
| Hot Separator Temp. °C., | 450 | 450 |
| Actual Feed Flow, g/h | 4535 | 4554 |
| Recycle Oil Flow, g/h | 9060 | 12700 |
| Recycle/Actual Feed Ratio | 2.0 | 2.8 |

After the completion of the runs, the pilot plant was dismantled and the solids deposited in the reactor and hot separator were collected. For run R-2-1-2, the total solids deposited were less than 10 grams and for run R-2-2-4 the collected solids were about 156 grams. There were no operational problems during the runs. Analysis of the reactor fluid withdrawn from three points of the reactor on different days of the run indicated that the ash content of the reactor fluid at the bottom of the reactor increased to about 20 weight percent on the ninth day after which it was nearly constant. At the middle and top of the reactor it was nearly constant at about 4 wt. %.

The yields and properties of light ends from the pilot plant runs were as follows:

TABLE 3

| Run Number | R-2-1-2 | R-2-2-4 |
|---|---|---|
| Reactor Temp., °C., | 450 | 460 |
| Hot Separator Temp. °C., | 450 | 450 |
| Yield on feed, wt. % | 69.6 | 72.3 |
| Yield on total liquid product, wt. % | 77.1 | 81.7 |
| API Gravity | 30.8 | 31.3 |
| Specific Gravity | 0.872 | 0.869 |
| Sulphur, wt. % | 1.98 | 1.77 |
| Nitrogen, ppm | 2436 | 2132 |

The yields and properties for heavy ends and recycle oil from the pilot plant were as follows:

TABLE 4

| Reactor Temperature<br>Run Number | 450° C.<br>R-2-1-2 | 460° C.<br>R-2-2-4 |
|---|---|---|
| Yield on feed, wt. % | 20.74 | 16.43 |
| Yield on total liquid product, wt. % | 22.95 | 18.33 |
| Specific gravity, | 1.095 | 1.129 |
| S. wt. % | 3.68 | 3.59 |
| N, ppm | 8916 | — |
| Ni, ppm | 241 | 361 |
| V, ppm | 755 | 1041 |
| Ash, wt. % | 2.67 | 3.53 |
| Conradson Carbon residue, wt. % | 30.14 | 36.52 |
| Pentane-insoluble, wt. % | 30.62 | 38.15 |
| Benzene-insoluble, wt. % | 10.82 | 14.95 |
| Distillate, wt. % | 55.6 | 54.2 |
| Distillate, sp. gr. | 0.990 | 1.004 |
| Pitch, wt. % | 44.4 | 45.8 |

The yields and pitch conversions for the two different runs are shown in Table 5 below:

TABLE 5

| Run Number | Operating Temperature °C. | Yields: Total Liquid Product Wt. %* | Total Liquid Product Vol % | −524° C. Oil Distillates wt. %* | −524° C. Oil Distillates Vol % | +524° C. Pitch wt. %* | +524° C. Pitch vol % | Pitch conversion wt. % | Hydrocarbon Gas Make g mol/kg | $H_2S$ Formation g mol/kg |
|---|---|---|---|---|---|---|---|---|---|---|
| R-2-1-2 | 450 | 92.3 | 99.7 | 81.1 | 92.1 | 11.2 | 7.6 | 81.5 | 2.03 | 0.674 |
| R-2-2-4 | 460 | 91.3 | 99.7 | 84.2 | 93.7 | 7.6 | 6.0 | 85.4 | 2.05 | 0.751 |

*Sulphur-free basis

The hydrogen consumption and hydrogen recirculation ratio are shown in Table 6 below:

TABLE 6

| Run Number | hydrogen g mol/kg feed: Feed | In the off gases | Chemically consumed | Hydrogen recirculation scf/bbl. |
|---|---|---|---|---|
| R-2-1-2 | 8.70 | 0.94 | 7.76 | 5848 |
| R-2-2-4 | 10.41 | 1.16 | 9.25 | 6055 |

The yields and properties of the different fractions of the distillate, i.e. the fraction boiling below 524° C. are shown in Table 7 below:

TABLE 7

| Reactor Temp. | 450° C. | 460° C. |
|---|---|---|
| Run Number | R-2-1-2 | R-2-2-4 |
| IBP to 200° C. | | |
| vol. % | 24.5 | 27.1 |
| sp. gr. | 0.760 | 0.756 |
| S, wt. % | 0.78 | 0.61 |
| N, wt. % | 0.06 | 0.07 |
| 200 to 250° C. | | |
| vol. % | 13.3 | 14.8 |
| sp. gr. | 0.854 | 0.857 |
| S, wt. % | 1.61 | 1.53 |
| N. wt. % | 0.09 | 0.11 |
| 250 to 333° C. | | |
| vol. % | 27.1 | 26.0 |
| sp. gr. | 0.908 | 0.912 |
| S, wt. % | 2.26 | 2.16 |
| N, wt. % | 0.15 | 0.18 |
| 333 to 418° C. | | |
| vol % | 24.2 | 22.1 |
| sp gr. | 0.969 | 0.976 |
| S, wt. % | 2.64 | 2.58 |
| N, wt. % | 0.38 | 0.45 |
| 418 to 524° C. | | |
| vol. % | 8.3 | 7.6 |
| sp. gr | 1.052 | 1.073 |
| S, wt. % | 3.46 | 3.46 |
| N, wt. % | 0.93 | 1.14 |

EXAMPLE 2

In order to demonstrate the effects of recycle rates on the liquid velocities in the reactor and hot separator, parallel tests were run with and without recycle at reactor temperatures of 450° C. and 460° C. The results are shown in Table 8 below:

TABLE 8

| Run Number | A-450 | B-450 | B-450 | B-460 |
|---|---|---|---|---|
| Reactor Temp °C. | 450 | 450 | 460 | 460 |
| Average Liquid flow, g/h in the reactor | 2192 | 11261 | 1955 | 14906 |
| Recycle oil withdrawal rate, g/h | — | 976 | — | 748 |
| Superificial liquid velocity in the reactor cm/sec. | 0.053 | 0.274 | 0.048 | 0.360 |
| Superficial average residence time for the first pass, h | 1.54 | 0.30 | 1.53 | 0.23 |
| Total residence time for the recycle oil, h | — | 3.8 | — | 5.4 |
| Liquid velocity in the separator, cm/sec./ | 0.059 | 0.244 | 0.037 | 0.330 |

The embodiments of the invention in which an exclusive property or privilege is claimed are defined as follows:

1. In a process for hydrocracking a heavy hydrocarbon oil feed stock, a substantial proportion of which boils above 524° C., wherein an intimate mixture of the heavy hydrocarbon oil and hydrogen is passed under upflow liquid conditions through a tubular hydrocracking zone having an L/D ratio of at least 2, said hydrocracking zone being maintained at a temperature between about 400° and 490° C. and a pressure between about 500 and 3,500 psig, a mixed effluent containing a gaseous phase comprising hydrogen and vaporous hydrocarbons and a liquid phase comprising heavy hydrocarbons is removed from the top of the hydrocracking zone and passed into a separate hot separator vessel also having an L/D ratio of at least 2, a gaseous stream comprising hydrogen and vaporous hydrocarbons is withdrawn from the top of the separator and a liquid stream comprising heavy hydrocarbons is withdrawn from the bottom of the separator, the improvement which comprises discharging the mixed effluent into the hot separator vessel in a lower region thereof below the liquid level in the separator to provide vigorous mixing action in the bottom of the separator and thereby substantially prevent coke deposits in the separator, said separator being maintained at a temperature between about 350° and 490° C., and recycling at least part of the liquid stream from the bottom of the separator without further treatment other than temperature adjustment to the bottom of the hydrocracking zone at a volume ratio of recycle liquid to feed stock of at least 2:1 to provide a liquid hourly space velocity in the hydrocracking zone of about 0.5 to 4.0 and a superficial liquid upflow velocity in the hydrocracking zone of at least 0.25 cm/sec such that deposition of coke in the hydrocracking zone is also substantially eliminated.

2. The process according to claim 1 wherein the superficial liquid upflow velocity in the hydrocracking zone is at least 0.25 cm/sec.

3. The process according to claim 1 wherein the hydrocracking is carried out at a pressure of 1000 to 2000 psig.

4. The process according to claim 1 wherein the hydrogen is recirculated at a rate of between 2,000 and 10,000 s.c.f. per bbl. of feed stock.

* * * * *